US006412419B1

(12) United States Patent
Brinkmann

(10) Patent No.: US 6,412,419 B1
(45) Date of Patent: Jul. 2, 2002

(54) SPIN-STABILIZED ARTILLERY PROJECTILE

(75) Inventor: Fritz Brinkmann, Werlte (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 09/450,780

(22) Filed: Nov. 30, 1999

(30) Foreign Application Priority Data

Dec. 2, 1998 (DE) ..... 198 55 535

(51) Int. Cl.[7] ..... F42B 14/02
(52) U.S. Cl. ..... 102/524
(58) Field of Search ..... 102/524, 525, 102/528

(56) References Cited

U.S. PATENT DOCUMENTS

| | | | | | |
|---|---|---|---|---|---|
| 996,820 | A | * | 7/1911 | Wray | |
| 2,110,264 | A | * | 3/1938 | Gerlich | |
| 2,927,535 | A | * | 3/1960 | Abramson et al. | 102/50 |
| 3,169,333 | A | | 2/1965 | Scanlon, Jr. | 42/69 |
| 3,744,426 | A | * | 7/1973 | Butler | 102/94 |
| 4,478,128 | A | | 10/1984 | Black et al. | 89/7 |
| 4,552,071 | A | * | 11/1985 | Horais et al. | 102/527 |
| 4,610,205 | A | * | 9/1986 | Bentley | 102/529 |
| 4,884,508 | A | * | 12/1989 | Kruse et al. | 102/524 |
| 5,081,931 | A | * | 1/1992 | Frye et al. | 102/489 |
| 5,164,540 | A | * | 11/1992 | Chiarellie et al. | 102/526 |
| 5,682,011 | A | * | 10/1997 | Sabranski et al. | 102/527 |
| 5,804,759 | A | | 9/1998 | Sauvestre | 102/439 |

FOREIGN PATENT DOCUMENTS

| | | | |
|---|---|---|---|
| CH | 17978 | 10/1898 | |
| DE | 40 00 167 | 4/1994 | F42B/14/02 |
| FR | 396083 | 4/1909 | |
| GB | 18191 | 5/1910 | |
| GB | 586674 | 3/1947 | |

* cited by examiner

*Primary Examiner*—Charles T. Jordan
*Assistant Examiner*—Kimberly S. Smith
(74) *Attorney, Agent, or Firm*—Venable; Gabor J. Kelemen

(57) ABSTRACT

A spin-stabilized projectile includes a projectile body having a longitudinal axis; a metal driving band mounted on the projectile body and having a circumferential groove surrounding the axis; and a plastic sealing ring seated in the groove and affixed to the projectile body.

5 Claims, 1 Drawing Sheet

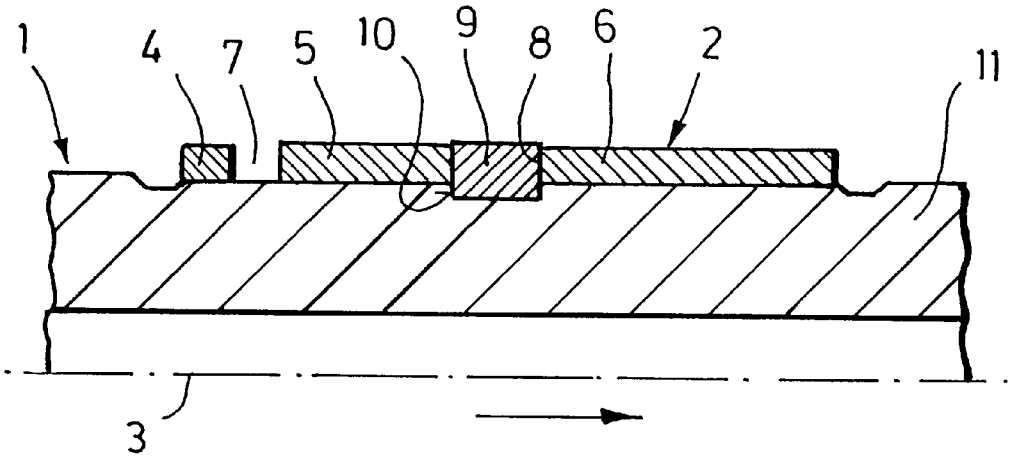
1
4
7
5
10
9
8
6
2
11
3

SPIN-STABILIZED ARTILLERY PROJECTILE

CROSS REFERENCE TO RELATED APPLICATION

This application claims the priority of German Application No. 198 55 535.0 filed Dec. 2, 1998, which is incorporated herein by reference.

BACKGROUND OF THE INVENTION

This invention relates to a spin-stabilized artillery projectile having a driving guide band and a plastic sealing ring circumferentially surrounding the projectile and being seated thereon. The driving band has at least one circumferential groove.

A projectile of the above-outlined type is disclosed in German Patent No. 40 00 167 to which corresponds U.S. Pat. No. 5,081,931. The projectile described therein has a driving band which is provided with a plurality of annular grooves and further has a plastic sealing ring disposed rearwardly of the driving band. The sealing ring which is also referred to as an obturator ring, serves for improving the seal of the projectile against the high-pressure propellant gases and is, as a rule, secured to the projectile by friction obtained by fit-shrinking.

It is a disadvantage of the above-outlined projectiles that the sealing ring can be easily damaged or destroyed by mechanical effects. Damaged or loosely sitting sealing rings are, during the loading process, readily stripped from the projectile which involves safety-related problems for the entire weapon system. It has further been found that the sealing rings are frequently lost from the projectile during transport thereof because their bias diminishes or disappears as the plastic material of the sealing ring ages.

Conventional projectiles having a plastic sealing ring arranged rearwardly of the driving band cannot be used in up-to-date large-caliber weapons (such as tank howitzers) which operate with an automated ammunition flow.

SUMMARY OF THE INVENTION

It is an object of the invention to provide an improved spin-stabilized artillery projectile of the above-outlined type in which the sealing ring, while fully preserving its sealing function, is securely prevented from damage or destruction or from being stripped from the projectile during introduction thereof into the loading chamber of the weapon.

This object and others to become apparent as the specification progresses, are accomplished by the invention, according to which, briefly stated, the spin-stabilized projectile includes a projectile body having a longitudinal axis; a metal driving band mounted on the projectile body and having a circumferential groove surrounding the axis; and a plastic sealing ring seated in the groove and affixed to the projectile body.

It is an essential principle of the invention to embed the sealing ring in a circumferential groove of the driving band rather than arranging it rearwardly of the driving band. Such an arrangement reliably protects the sealing ring against damage and practically excludes the possibility of the sealing ring being stripped from the projectile.

The defined seat of the sealing ring in the circumferential groove of the driving band ensures an improvement and a higher reliability of the sealing function and also results in a reduction of the weapon barrel wear.

Further, existing projectiles which are, because of their rearwardly arranged sealing ring, not adapted for use in up-to-date automatic weapon systems may be readily retrofitted with the arrangement of the invention in a suitable manner. In such a case it is only required to axially widen, if necessary, the already existing groove in the driving band and to insert the sealing ring into the groove and, if required, frictionally connect the sealing ring with the projectile.

BRIEF DESCRIPTION OF THE DRAWING

The sole FIGURE is a fragmentary axial sectional view of a projectile incorporating the invention.

DESCRIPTION OF THE PREFERRED EMBODIMENT

FIG. 1 shows an artillery projectile 1 in a fragmentary manner in the region of its driving band 2 which may be made, for example, of copper. The driving band is composed of three axially spaced driving parts 4, 5 and 6 between which two circumferential clearances constituting circumferential grooves 7 and 8 are provided. According to the invention, in the groove 8 provided approximately in the axial middle of the driving band 2, a sealing ring 9 made of polyamide 6.6 is arrange which is partially sunk into a circumferential groove 10 provided in the projectile wall 11 and is frictionally or form-fittingly connected therewith.

For retrofitting an already existing artillery projectile the corresponding, usually relatively narrow annular groove of the existing driving band is enlarged in the axial direction by machining to correspond to the dimension of the sealing ring to be inserted.

The sealing ring is manufactured to be oversized and is obliquely transversely split, so that when the split ends are superimposed, the desired inner and outer diameters result.

Thereafter, the sealing ring is positioned into the enlarged annular groove of the driving band and the superposed split ends of the sealing ring are permanently bonded by a suitable glue.

It is to be understood that the invention is not limited to the described embodiment. Thus, for example, the driving band and sealing ring may be made of other suitable materials rather than copper and, respectively, polyamide. Further, the annular groove for the sealing ring need not necessarily be provided in the mid part of the driving band but may be located in other parts thereof.

It will be understood that the above description of the present invention is susceptible to various modifications, changes and adaptations, and the same are intended to be comprehended within the meaning and range of equivalents of the appended claims.

What is claimed is:

1. A spin-stabilized projectile comprising (a) a projectile body having a longitudinal axis;

(b) a metal driving band mounted on said projectile body; said metal driving band including two axially separated circumferential driving band parts defining therebetween a circumferential groove; and (c) a plastic sealing ring seated in said circumferential groove and being contiguously affixed to said projectile body.

2. The spin-stabilized projectile as defined in claim 1, further comprising an additional circumferential groove provided in an outer surface of said projectile body in alignment with said circumferential groove defined by said driving band parts; said sealing ring being seated in said additional circumferential groove.

3. The spin-stabilized projectile as defined in claim 1, wherein said sealing ring is affixed to said projectile body by a frictional engagement between said sealing ring and said projectile body.

4. The spin-stabilized projectile as defined in claim 1, wherein said sealing ring is affixed to said projectile body by a form-fitting engagement between said sealing ring and said projectile body.

5. The spin-stabilized projectile as defined in claim 1, wherein said sealing ring is of polyamide 6.6.

* * * * *